United States Patent [19]

Frei

[11] 4,217,734

[45] Aug. 19, 1980

[54] GRINDING MACHINE

[75] Inventor: Max Frei, Schönenwerd, Switzerland

[73] Assignee: Schenker Maschinen AG, Schönenwerd, Switzerland

[21] Appl. No.: 880,566

[22] Filed: Feb. 23, 1978

[30] Foreign Application Priority Data

Mar. 15, 1977 [CH] Switzerland ..... 319277

[51] Int. Cl.[2] ..... B24B 49/04

[52] U.S. Cl. ..... 51/118; 51/165.88

[58] Field of Search ..... 51/111 R, 112, 116, 51/118, 165 R, 165.91, 165.92, 165.88

[56] References Cited

U.S. PATENT DOCUMENTS

| | | | |
|---|---|---|---|
| 2,753,667 | 7/1956 | Whitelaw | 51/118 |
| 3,001,337 | 9/1961 | Dunn | 51/111 R |
| 3,079,740 | 3/1963 | Fallon | 51/111 R X |
| 3,561,164 | 2/1971 | Dunn | 51/116 |
| 3,889,428 | 6/1975 | Steinegger et al. | 51/112 |

FOREIGN PATENT DOCUMENTS

| | | | |
|---|---|---|---|
| 2427709 | 12/1975 | Fed. Rep. of Germany | 51/118 |
| 1207780 | 2/1960 | France | 51/111 R |

OTHER PUBLICATIONS

Rutbell, *IBM Technical Disclosure Bulletin*, "Straddle Grinding Machine," vol. 4, No. 6, Nov. 1961, pp. 3–4.

*Primary Examiner*—Harold D. Whitehead
*Assistant Examiner*—Robert P. Olszewski
*Attorney, Agent, or Firm*—Peter K. Kontler

[57] ABSTRACT

A grinding machine with two spaced-apart coaxial grinding wheels wherein the workpieces are transported through the space between the neighboring parallel active surfaces of the grinding wheels. A gauge monitors the length of workpieces which issue from the space and closes a microswitch when the monitored length of workpieces reaches a predetermined value which is close to or equals the upper limit of the acceptable range of lengths. The microswitch completes a circuit which causes a motor for one of the grinding wheels to move the one grinding wheel nearer to the other grinding wheel. The distance between the active surface of the other grinding wheel and a fixed reference point in the space between the wheels is monitored by a transducer which causes a motor for the other grinding wheel to move the latter toward the one grinding wheel when the aforementioned distance reaches a preselected maximum permissible value while the gauge closes the microswitch. The motor for the one grinding wheel is idle when the motor for the other grinding wheel is operative, and vice versa. The motors move the grinding wheels in stepwise fashion, and the length of increments through which the grinding wheels are moved toward each other can be selected by the attendant.

14 Claims, 2 Drawing Figures

FIG. 2

FIG. 1
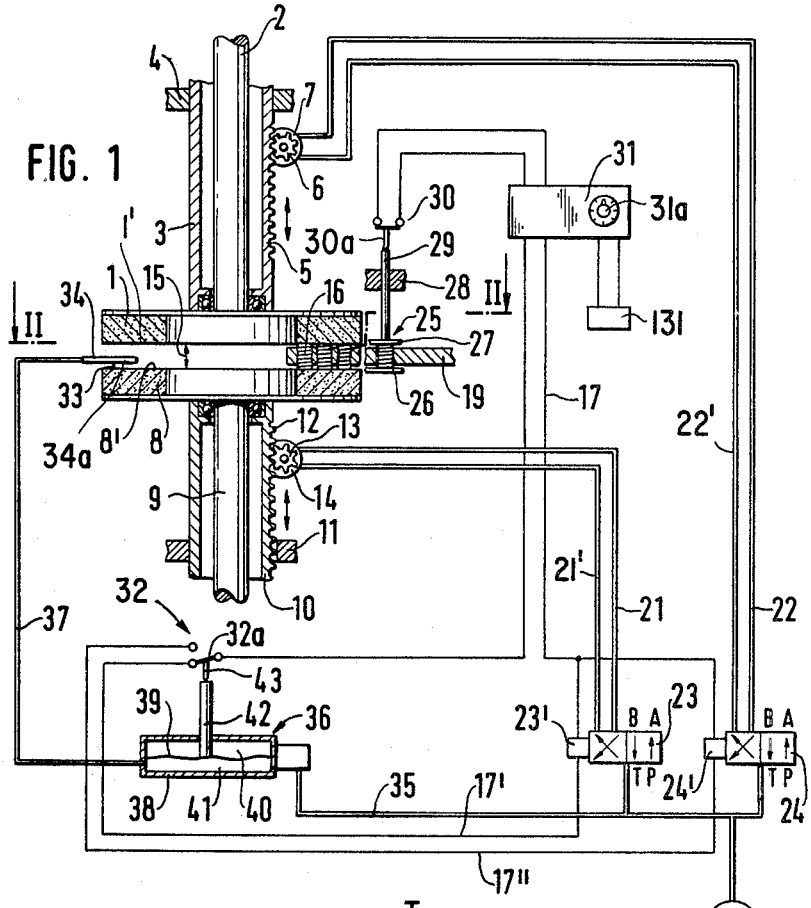
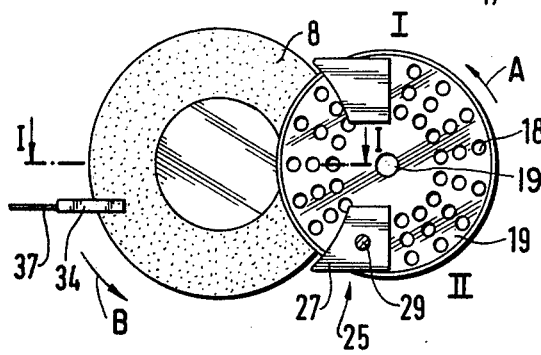
FIG. 2

GRINDING MACHINE

BACKGROUND OF THE INVENTION

The present invention relates to grinding machines in general, and more particularly to grinding machines of the type wherein the workpieces to be treated are transported between the active surfaces of two rotary grinding wheels. Still more particularly, the invention relates to improvements in grinding machines of the type wherein the grinding wheels are movable toward each other in order to compensate for wear upon their active surfaces.

Grinding machines of the above outlined character are disclosed, for example, in Swiss Pat. No. 577,873. One of many purposes of such machines is to grind the ends of helical springs. The springs are transported sideways through the space between the parallel active surfaces of the grinding wheels so that each grinding wheel treats a different end of each spring which is located in the space between the active surfaces. The wear upon the active surfaces is quite pronounced; therefore, such machines are equipped with means for moving the grinding wheels sideways whenever the length of treated workpieces (as considered at right angles to the planes of the active surfaces) exceeds a predetermined value at the upper end of the range of acceptable lengths. In other words, the means for moving the grinding wheels must compensate for wear upon the active surfaces so that the length of treated workpieces invariably remains within the range of acceptable lengths. In presently known two-wheel grinding machines, the adjustments of grinding wheels are effected by hand. The person in charge must be conscientious, alert and experienced, especially since the wear upon both grinding wheels is not always identical and particularly if the person in charge must rely on visual observation of the width of space between the active surfaces and/or of the length of treated workpieces. In other words, the person in charge must ascertain, preferably without any delay or with negligible delay, that the length of treated workpieces is excessive and such person must also detect that grinding wheel which is to be shifted toward the other grinding wheel. Delays in detection of unsatisfactory workpieces and/or in appropriate adjustment of the grinding wheel or wheels result in substantial losses in output or customer complaints and attendant inconveniences.

OBJECTS AND SUMMARY OF THE INVENTION

An object of the invention is to provide a two-wheel grinding machine with novel and improved means for automatically maintaining the width of the space between the active surfaces of the grinding wheels within a range which insures adequate or optimum treatment of each of a long series of workpieces.

Another object of the invention is to provide a grinding machine of the just outlined character wherein the adjustment of grinding wheels need not be supervised at all, wherein the adjustment is effected at desired intervals and practically without any delay whenever the width of the space between the grinding wheels is excessive or approaches the maximum permissible value, and wherein the means for adjusting the positions of grinding wheels with respect to each other is simple, compact, rugged and reliable.

A further object of the invention is to provide novel and improved means for moving the grinding wheels relative to each other, and novel and improved means for initiating the movements of grinding wheels in automatic response to detection of workpieces whose length approximates or approaches the maximum permissible length.

An additional object of the invention is to provide the grinding machine with novel and improved means for monitoring the workpieces (and/or one or more components of the machine proper) in order to insure the initiation of appropriate adjustment even before the machine begins to turn out unsatisfactory workpieces.

An ancillary object of the invention is to provide the machine with novel and improved means for monitoring the width of the space between the active surfaces of the grinding wheels.

The invention is embodied in a grinding machine which comprises preferably coaxial first and second rotary grinding wheels having substantially parallel active surfaces which face each other and define a space or gap whose width varies as a function of wear upon the active surfaces, drive means which is actuatable to move the first grinding wheel in a direction to reduce the width of the space between the active surfaces, means for transporting helical springs or other types of workpieces along a path which extends through and beyond the space between the active surfaces whereby the workpieces are treated by the grinding wheels and their length, as considered at right angles to the planes of the active surfaces, denotes the width of the space between the grinding wheels, means for monitoring the length of workpieces in the path beyond the space between the grinding wheels (such monitoring of the length of treated workpieces is tantamount to monitoring of the width of the space between the grinding wheels), and means for actuating the first drive means when the monitored length of workpieces exceeds a predetermined value (namely, a value which constitutes or approaches the upper limit of the range of acceptable lengths) so that the drive means reduces the width of the space between the active surfaces by moving the first grinding wheel toward the second grinding wheel until the width of the space is reduced to a value not exceeding the predetermined value. The machine preferably further comprises second drive means which is actuatable to move the second grinding wheel toward the first grinding wheel, marker means (e.g., a hollow fluid conveying member or an inductive or capacitive proximity switch) defining a fixed reference point between the active surfaces (i.e., in the space between the grinding wheels), means for monitoring the distance between the fixed reference point and the active surface of one of the grinding wheels (preferably the second grinding wheel), and second actuating means for actuating the second drive means when the monitored length of workpieces exceeds the predetermined value while, at the same time, the distance between the fixed reference point and the active surface of the one (second) grinding wheel exceeds a preselected value which is indicative of pronounced wear upon the one grinding wheel. If the wear upon both grinding wheels is identical or nearly identical, the two actuating means are likely to effect alternative operation or actuation of the respective drive means, i.e., an adjustment of the first grinding wheel will be followed by an adjustment of the second grinding wheel, such adjustment of the second grinding wheel will be followed by an adjustment of the first grinding wheel, and so forth. However, if the wear upon the two grinding wheels is not uniform, one of the drive means is likely to be actuated twice or more often in a row prior to an actuation of the other drive means.

The two drive means preferably comprise a common source of energy (e.g., a source of pressurized gaseous or hydraulic fluid if the drive means comprise pneumatic or hydraulic motors) and discrete first and second motors which are operable to respectively move the first wheel toward the second wheel and the second wheel toward the first wheel in response to connection with the energy source. The first actuating means then includes means for connecting the first motor with the energy source when the monitored length of workpieces exceeds the predetermined value and the distance between the active surface of the one (second) grinding wheel and the fixed reference point is less than the preselected value. The second actuating means includes means for connecting the second motor with the energy source when the monitored length of workpieces exceeds the predetermined value and, at the same time, the distance between the fixed reference point and the active surface of the one (second) grinding wheel exceeds the preselected value.

The novel features which are considered as characteristic of the invention are set forth in particular in the appended claims. The improved grinding machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary partly sectional and partly diagrammatic view of a two-wheel grinding machine which embodies the invention, the section being taken along the line I—I of FIG. 2; and FIG. 2 is a sectional view as seen in the direction of arrows from the line II—II of FIG. 1.

DESCRIPTION OF THE PREFERRED EMBODIMENTS

Referring first to FIG. 1, there is shown a portion of a grinding machine which comprises an upper grinding wheel 1 secured to an upwardly extending upright drive shaft 2. The shaft 2 is rotatably journalled in and is movable axially with a tubular guide 3 which is reciprocable in suitable bearings 4. The drive means for moving the guide 3 and the shaft 2 (with the upper grinding wheel 1) downwardly, as viewed in FIG. 1, comprises a toothed rack 5 which is secured to or made integral with the guide 3 and extends in parallelism with the common axis of the parts 1–3, a pinion 6 which is mounted in the frame (not shown) of the grinding machine and meshes with the rack 5, and a prime mover 7 (e.g., a pneumatic motor) whose output shaft transmits torque to (and may be directly connected with) the pinion 6. The prime mover 7 may be a reversible motor so that the upper grinding wheel 1 can be moved up or down. Upward movement of the grinding wheel 1 is necessary, at times, to move a fresh grinding wheel to an upper end position or to adjust the machine prior to treatment of differently dimensioned and/or configurated workpieces.

The upper grinding wheel 1 is coaxial with and is spaced apart from a second or lower grinding wheel 8 which is movable axially toward and away from the upper wheel 1 and is driven in a manner identical with or analogous to that described in connection with the wheel 1. Thus, the wheel 8 is rigid with the upper end of a drive shaft 9 which is coaxial with the shaft 2 and is rotatably journalled in a tubular guide 10 which, in turn, is reciprocable in suitable bearings 11. The guide 10 has a toothed rack 12 in mesh with a pinion 13 which can receive torque from a preferably reversible prime mover 14 corresponding to the prime mover 7. The prime mover or prime movers which rotate the shafts 2 and 9 for the grinding wheels 1 and 8 are not shown in the drawing.

The width of the space 15 between the parallel working or active surfaces 1′ and 8′ of the grinding wheels 1 and 8 must correspond to the desired (optimum) length of workpieces 16 which are transported by a turntable 19 so that the active surfaces 1′ and 8′ respectively grind the upper and lower end portions of the workpieces. Each of the illustrated workpieces 16 is a helical spring. As shown in FIG. 2, the turntable 19 has several annuli of openings or bores 18 each of which receives workpieces 16 at a first or loading station I located ahead of the locus where the openings 18 enter the space 15 between the grinding wheels 1 and 8. The finished workpieces 16 are removed or expelled from their openings 18 at a second station II which is located downstream of the location where the openings 18 emerge from the space 15. The arrow A indicates the direction of rotation of the turntable 19 about the axis of a vertical shaft 19*a* which receives torque from prime mover means for the shafts 2, 9 or from a separate prime mover, not shown. The arrow B indicates the direction of rotation of the grinding wheels 1 and 8. The path which is defined by the turntable 19 is a horizontal path, i.e., the axes of the workpieces 16 in such path are vertical and normal to the planes of the active surfaces 1′ and 8′.

As mentioned above, the prime movers 7 and 14 may constitute pneumatic motors. Therefore, the grinding machine comprises or is connected with a source 20 of pressurized gaseous fluid. The supply conduits which deliver pressurized fluid from the source 20 to the motors 7 and 14 are respectively shown at 22 and 21. These conduits respectively contain solenoid-operated valves 24 and 23. The solenoids are shown at 24′ and 23′. The reference characters 22′ and 21′ respectively denote return conduits which connect the motors 7 and 14 with the respective valves 24 and 23.

It will be readily appreciated that the pneumatic motors 7 and 14 can be replaced with electric motors, mechanical motors, electronic torque transmitting means or hydraulic motors without departing from the spirit of the invention. The grinding machine will then contain or will be connected with different sources of energy and certain other parts will require some modifications of a nature that will be readily comprehended by those skilled in the art upon perusal of this description.

In accordance with a feature of the invention, the grinding machine further comprises a gauge or monitoring means 25 which measures the length of finished workpieces 16, i.e., the length of those workpieces whose end portions were treated by the active surfaces 1′ and 8′ during travel in the space 15 between the grinding wheels 1 and 8. To this end, the gauge 25 is installed adjacent to the path of some or all finished workpieces 16 intermediate the space 15 between the grinding wheels 1, 8 and the removing or ejecting station II.

The gauge 25 comprises a fixedly mounted plate-like component 26 whose upper side is coplanar or substantially coplanar with the active surface 8' of the lower grinding wheel 8 and which is disposed below the turntable 19 so that its upper side is or can be contacted by the lower end portions of finished workpieces 16. A second plate-like component 27 of the gauge 25 is located at a level above the turntable 19 opposite the component 26 and is fixedly secured to the lower end portion of a motion transmitting rod 29 which is reciprocable in suitable bearings 28. As shown in FIG. 1, at least one of the components 26, 27 is bevelled in the region where successive finished workpieces 16 enter between these components to insure that the gauge 25 does not interfere with angular movement of the turntable 19. The finished workpieces 16 which advance through the space between the plate-like components 26, 27 maintain these components at a distance from each other which matches the width of the space 15, i.e., the distance between the active surfaces 1' and 8'. The upper component 27 and/or the rod 29 can be biased downwardly toward the component 26 to insure that the distance between the components 26, 27 invariably denotes the length of finished workpieces 16.

If the length of finished workpieces 16 is excessive, the workpieces cause the component 27 to rise to or above a predetermined level at which the upper end face of the rod 29 actuates a detector 30 (preferably a microswitch) by way of a suitable trip 30*a*. When the switch 30 is closed (i.e, when the length of finished workpieces 16 exceeds a predetermined value), the switch 30 completes a portion of a circuit 17 which includes a suitable (preferably adjustable) pulse generator or timer 31. The circuit 17 further includes the aforementioned solenoids 23' and 24' an energy source 131 and a two-position switch 32. The switches 30, 32 constitute the means for actuating the drive means 5–7 for the upper grinding wheel 1. The switch 32 can be caused to change the position of its movable contact 32*a* by a transducer 36. When the movable contact 32*a* assumes the position of FIG. 1, the energy source 131 is connected with the solenoid 23' at intervals and for periods determined by setting of the timer 31 so that the valve 23 opens and closes at intervals determined by the timer and causes the motor 14 to move the lower grinding wheel 8 upwardly in stepwise fashion. The reference character 17' denotes conductor means which connects the switch 32 with the solenoid 23'.

When the transducer 36 changes the position of the movable contact 32*a*, the circuit of the solenoid 24' is completed (via conductor means 17'') at intervals determined by the timer 31 so that the motor 7 causes the upper grinding wheel 1 to descend in stepwise fashion and to thus reduce the width of the space 15 between the active surfaces 1' and 8'.

The means for selecting the length of intervals at which the timer 31 completes the circuit 17 includes a knob 31*a* which is rotatable with respect to a suitably calibrated scale on the housing of the timer 31. Each incremental advance of the grinding wheel 1 toward the grinding wheel 8 (and vice versa) is preferably very small or relatively small so that the width of the space 15 between the active surfaces 1' and 8' can be adjusted with a high degree of accuracy.

The switch 32 determines whether the completion of electric circuit 17 results in energization of the solenoid 23' or 24', i.e., whether the lower grinding wheel 8 moves stepwise toward the upper grinding wheel 1 or vice versa. The means for controlling the position of the movable contact 32*a* by way of the transducer 36 comprises a hollow fixed reference marker 34 having an orifice 34*a* which discharges pressurized fluid (e.g., compressed air) against the active surface 8' of the lower grinding wheel 8. The outer end portion of the marker 34 is connected with the source 20 by supply conduits 35, 37 and the transducer 36. The arrangement is such that the distance 33 between the fixed reference point (defined by the discharge end of the orifice 34*a*) and the active surface 8' determines the position of the movable contact 32*a*.

The transducer 36 comprises a housing 38 which contains a deformable membrane 39 serving to divide its interior into an upper chamber 40 and a lower chamber 41. The membrane 39 is connected with an upwardly extending rod-like sensor 42 which can actuate a trip 43 of the two-position switch 32. The lower chamber 41 connects the conduit 35 with the conduit 37, and the upper chamber 40 communicates with the atmosphere or contains a body of confined fluid which is maintained at a predetermined pressure. The sensor 42 can be said to constitute an element of the means for actuating the drive means 12–14 for the lower grinding wheel 8.

When the width of the space 15 between the active surfaces 1' and 8' does not exceed a predetermined value which is indicative of unsatisfactory finished workpieces 16, the switch 30 is open and the circuit 17 is also open, i.e., the motors 7 and 14 are idle. The orifice 34*a* of the reference marker 34 constitutes a flow restrictor. If the distance 33 is such that the rate of flow of gaseous fluid from the conduit 37 via orifice 34*a* is kept below a given value, the pressure in the lower chamber 41 of the transducer 36 is sufficiently high to cause a deformation of the membrane 39 in a direction to maintain the moving contact 32 in the upper position in which the solenoid 24' is energized at intervals determined by the timer 31 as soon as the microswitch 30 closes on upward movement of the component 27, i.e, as soon as the wear upon the active surface 1' and/or 8' is sufficiently pronounced to warrant a reduction of the width of space 15. If the distance 33 remained unchanged or substantially unchanged, i.e., if the pressure in the chamber 41 still suffices to maintain the contact 32*a* in the upper position, closing of the switch 30 results in downward movement of the upper grinding wheel 1 in stepwise fashion until the microswitch 30 opens again, i.e., the downward movement of grinding wheel 1 is terminated when the width of the space 15 is reduced to a value at which the active surfaces 1' and 8' insure that the length of finished workpieces 16 will not be excessive. The switch 30 is a normally idle common connector for both motors (7 and 14) to the source 20, i.e., this switch is located in the path of energy flow to both motors and is activated by the rod 29 in response to displacement of the component 27 to a position in which the distance between the components 26, 27 exceeds the predetermined value.

If the wear upon the active surface 8' is more pronounced than the wear upon the active surface 1' (or, otherwise, stated, when the wear upon the surface 8' is sufficiently pronounced to allow the pressure in the chamber 41 to drop to a value at which the moving contact 32*a* of the switch 32 assumes the position shown in FIG. 1), the switch 32 insures that closing of the microswitch 30 by the gauge 25 results in stepwise movement of the lower grinding wheel 8 toward the upper grinding wheel 1. Again, such stepwise or incremental advance of the wheel 8 is terminated on opening of the microswitch 30, i.e., when the width of the space 15 between the active surfaces 1' and 8' is reduced sufficiently to insure that the length of the workpieces 16 is acceptable. The aforementioned drop of pressure in the chamber 41 is caused by escape of a larger quantity of gas via orifice 34*a* because the distance 33 has increased as a result of pronounced wear upon the active surface 8'. As the lower grinding wheel 8 rises, the distance between the fixed reference point defined by the marker 34 and the active surface 8' decreases, i.e., the pressure in the chamber 41 rises again and is sufficiently high to move the contact 32*a* to the upper position not later than when the microswitch 30 opens.

It will be noted that the monitoring means including the transducer 36 constitutes a device which determines whether the grinding wheel 1 will be moved toward the grinding wheel 8 or vice versa. The grinding wheel 1 will descend whenever the distance 33 is less than a preselected value such as is necessary to enable the contact 32*a* to assume the position of FIG. 1; in other instances, the grinding wheel 8 will move toward the grinding wheel 1 whenever the microswitch 30 is closed, i.e., when the length of treated workpieces 16 exceeds a predetermined value which equals or approximates the maximum permissible length of finished workpieces.

Extensive experiments with the improved grinding machine indicate that, by properly selecting the material of the grinding wheels, one can dispense with the customary dressing tools because the wear upon both grinding wheels is sufficiently uniform to allow for reliance upon automatic adjustment of grinding wheel 1 in a direction toward the grinding wheel 8 or vice versa. The elimination of or absence of the need for the dressing tools contributes to a reduction of the initial and maintenance cost and results in greatly increased output because the machine can be operated without interruptions such as are customary in conventional machines in order to enable the dressing tool or tools to treat the active surfaces of the grinding wheels.

Another important advantage of the improved grinding machine is that the number of rejects is reduced to a fraction of those in machines wherein the adjustments of grinding wheels are carried out by hand. In fact, the number of rejects (including those workpieces whose length is excessive) is nil if the gauge 25 is calibrated in such a way that the microswitch 30 opens when the width of the space 15 between the active surfaces 1' and 8' reaches a predetermined value which is less than the maximum permissible length of treated workpieces.

As mentioned above, the hollow marker 34 can be replaced with a marker in the form of a capacitive or inductive proximity switch. The transducer 36 is then replaced with a relay which shifts the movable contact 32*a* in response to signals from the proximity switch; such signals denote that the active surface 8' is sufficiently close to or too far away from the proximity switch.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a grinding machine, the combination of first and second rotary grinding wheels having substantially parallel active surfaces facing each other and defining a space whose width varies as a function of wear upon said surfaces; first drive means actuatable to move said first wheel in a direction to reduce the width of said space; means for transporting workpieces along a path which extends through and beyond said space whereby the workpieces are treated by said wheels and their length, as considered at right angles to the planes of said active surfaces, denotes the width of said space; first monitoring means for monitoring the length of workpieces in said path beyond said space; first actuating means for actuating said first drive means; second drive means actuatable to move said second grinding wheel toward said first grinding wheel; marker means defining a fixed reference point in said space; second monitoring means for monitoring the distance between said reference point and the active surface of said second wheel and for generating a monitoring signal when the distance monitored by said second monitoring means exceeds a preselected value; second actuating means for actuating said second drive means; and means for energizing only one of said actuating means when the monitored length of the workpieces exceeds a predetermined value, said energizing means energizing said second actuating means in the presence, and said first actuating means in the absence, of said monitoring signal.

2. The combination of claim 1, further comprising a source of energy, said first drive means and said second drive means respectively comprising discrete first and second motors operable to respectively move said first wheel toward said second wheel and said second wheel toward said first wheel in response to connection with said source, said energizing means including means for connecting said first motor with said source when the monitored length of workpieces exceeds said predetermined value and said distance is less than said preselected value, and means for connecting said second motor with said source when the monitored length of workpieces exceeds said predetermined value and said distance exceeds said preselected value.

3. The combination of claim 2, wherein said first monitoring means comprises a gauge having a stationary component adjacent to one side of said path downstream of said space, as considered in the direction of movement of workpieces along said path, and a mobile second component adjacent to the other side of said path opposite said stationary component and being displaceable by treated workpieces so that the distance between said components denotes the width of said space, said connecting means including a normally idle common connector disposed in the path of energy flow from said source to both motors and means for activating said common connector in response to displacement of said second component to a position in which the distance between said components exceeds said predetermined value.

4. The combination of claim 3, wherein said first component has a surface which is substantially coplanar with said second active surface when the distance between said second active surface and said reference point is less than said preselected value.

5. The combination of claim 4, wherein said common connector is an electric switch.

6. The combination of claim 1, wherein said actuating means include means for effecting the operation of said drive means in stepwise fashion at intervals of predetermined length.

7. The combination of claim 6, further comprising means for varying the length of said intervals.

8. The combination of claim 1, wherein said marker means includes a hollow member having an orifice facing said second active surface, and said second monitoring means includes means for supplying to said hollow member a stream of pressurized fluid which issues by way of said orifice and impinges upon said second surface whereby the pressure of fluid in said hollow member varies with changes in said distance, and means for measuring the pressure of fluid in said hollow member.

9. The combination of claim 8, wherein said hollow member includes a portion which is disposed between said surfaces and further comprising conduit means for supplying fluid to said portion.

10. The combination of claim 8, wherein said measuring means includes a transducer including a mobile portion whose position is indicative of the pressure of fluid in said hollow member, said second actuating means being operative to actuate said second drive means when the position of said mobile portion is indicative of a pressure at which said distance exceeds said preselected value.

11. The combination of claim 8, wherein said fluid is a compressed gas.

12. The combination of claim 8, wherein said fluid is a liquid.

13. The combination of claim 1, wherein said marker means forms part of a proximity switch.

14. The combination of claaim 1, wherein one of said grinding wheels is disposed above the other of said grinding wheels.

* * * * *